US006523580B1

(12) United States Patent
Awad

(10) Patent No.: US 6,523,580 B1
(45) Date of Patent: Feb. 25, 2003

(54) AUTOMOTIVE RADIATOR FLUSH SYSTEM AND METHODS OF USE

(76) Inventor: Adam Awad, 1360 Logan Ave., #100, Costa Mesa, CA (US) 92626

( * ) Notice: Subject to any disclaimer, the term of this patent is extended or adjusted under 35 U.S.C. 154(b) by 0 days.

(21) Appl. No.: 10/006,345

(22) Filed: Dec. 3, 2001

(51) Int. Cl.[7] ..... B65B 1/04
(52) U.S. Cl. ..... 141/65; 141/59; 184/1.5
(58) Field of Search ..... 141/65, 67, 59, 141/301, 302, 98, 94, 95, 192, 198; 184/1.5

(56) References Cited

U.S. PATENT DOCUMENTS 4,109,703 A * 8/1978 Babish et al. ..... 165/95
5,103,878 A 4/1992 Cassia
5,615,716 A 4/1997 Akazawa et al.
5,649,574 A 7/1997 Turcotte et al.
5,845,684 A 12/1998 Fletcher, Jr. et al.
6,073,666 A * 6/2000 Clark, II ..... 141/83
6,213,175 B1 * 4/2001 Rome et al. ..... 141/98
6,234,215 B1 5/2001 Klamm

FOREIGN PATENT DOCUMENTS

EP 1013908 A1 6/2000

* cited by examiner

*Primary Examiner*—Steven O. Douglas
(74) *Attorney, Agent, or Firm*—Gene Scott-Patent Law & Venture Group

(57) ABSTRACT

An apparatus comprises a wheeled cart, and mounted on the wheeled cart a plurality of containers placed in adjacent upright attitudes. A support framework engages the wheeled cart and further provides a support framework engaging an operator's panel with operator's controls. A suction developing device, pressure developing device, conduit switching device, and conduit manifolding device, are enabled for acting together to apply vacuum and pressure exertion on fluids for driving such fluids between the containers and an automotive radiator through a system of conduits.

12 Claims, 10 Drawing Sheets

AUTOMOTIVE RADIATOR FLUSH SYSTEM AND METHODS OF USE

BACKGROUND OF THE INVENTION

1. Field of the Invention

This invention relates generally to automotive radiator flush systems and their methods of use and more particularly to an automated or manually operated such system and its methods and especially to such a system with controls for switching to various modes of operation.

2. Description of Related Art

The following art defines the present state of this field:

Cassia, U.S. Pat. No. 5,103,878 describes a flush cap for a vehicle cooling system wherein the flush cap has an inlet through which fresh water enters and an outlet through which dirty coolant leaves. The method employs the flush cap to flush the cooling system of the vehicle. The radiator cap can be adapted to drain a radiator using a hose attached to the outlet of the cap.

Akazawa, U.S. Pat. No. 5,615,716 describes an engine coolant changing apparatus for changing an engine coolant such as LLC (long-life coolant) in an engine coolant path containing a radiator, comprising coolant storing means possessing a pressure action port and a liquid inlet and outlet, detaching mechanism to be attached or detached to or from a filler port of a radiator, communicating device for communicating between the liquid inlet and outlet and the detaching device, and pressure action device for applying a negative pressure to the pressure action port to overheat the coolant to a low temperature by driving an engine when discharging the coolant from an engine coolant system, and applying a positive pressure to the pressure action port when feeding a fresh liquid, so that the coolant can be changed promptly in a short time, without requiring manipulation of radiator drain cock or jack-up of the vehicle.

Turcotte et al., U.S. Pat. No. 5,649,574 describes a removal and refill apparatus for use in removing and/or refilling coolant in an automotive cooling system. The automotive cooling system typically includes a radiator, overflow bottle, engine, water pump, and heater core elements. A method for utilizing the coolant removal and refill apparatus utilizing vacuum and pressure is described for use with the removal and refill apparatus.

Fletcher, Jr. et al., U.S. Pat. No. 5,845,684 describes a clean and easy-to-use, portable upright apparatus, and a method for its use, which can be used to flush and fill the radiator and coolant systems of motorized vehicles in approximately 15 minutes, the apparatus comprising a self-priming pump, a waste collection tank, a tank for holding new or recycled coolant, a filter assembly, and a wheeled support structure for conveniently and efficiently housing the pump, tanks, filter assembly, and the several hoses needed to perform the flush and fill procedure. Applications may include, but are not limited to, flushing coolant from automobile radiators and refilling them with new or recycled coolant.

Klamm, U.S. Pat. No. 6,345,215 describes an apparatus for adding coolant to a cooling system of a motor vehicle including a cap with a resilient sleeve that expands against the inside wall of a radiator filler neck to provide an air-tight connection. A valve attached to the cap controls the flow of air and coolant through the cap. A gauge on the cap indicates the pressure inside the radiator. A venturi assembly connected to the valve provides a source of vacuum for evacuating air from the cooling system. Thereafter, coolant is drawn through the cap by the vacuum created in the system.

Gayet, EP 1013908 describes a coolant fluid replacement device for an automobile, utilizing an open loop distribution circuit within the coolant loop during the replacement of the used coolant. The coolant loop comprises a radiator that includes an inlet from the engine and an outlet to the engine. During the coolant replacement process, the device is connected between the coolant pumps of the vehicle system. The new fluid is stored in a first reservoir. As the new fluid is pumped into the system, the old fluid is forced out into a second reservoir.

The prior art teaches the use of carts for providing automotive maintenance and especially in the field of radiator cleaning and refilling, but does not teach a combination cart with storage containers and a control panel all in wheeled portable configuration for easy selection of the maintenance steps to be taken. The present invention fulfills these needs and provides further related advantages as described in the following summary.

SUMMARY OF THE INVENTION

The present invention teaches certain benefits in construction and use which give rise to the objectives described below.

An apparatus comprises a wheeled cart, and mounted on the wheeled cart a plurality of containers placed in adjacent upright attitudes. A support framework engages the wheeled cart and further provides a support framework engaging an operator's panel with operator's controls. A suction developing device, pressure developing device, conduit switching device, and conduit manifolding device, are enabled for acting together to apply vacuum and pressure exertion on fluids for driving such fluids between the containers and an automotive radiator through a system of conduits.

A primary objective of the present invention is to provide an apparatus and method of use of such apparatus that provides advantages not taught by the prior art.

Another objective is to provide such an invention capable of moving fluids between containers and an automotive radiator for cleaning and refilling.

A further objective is to provide such an invention capable of quick and easy modification for various applications.

A still further objective is to provide such an invention capable of valving a fluid such as a cleaning or treatment agent, directly from a bottle into a nozzle fitted to an automobile radiator.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
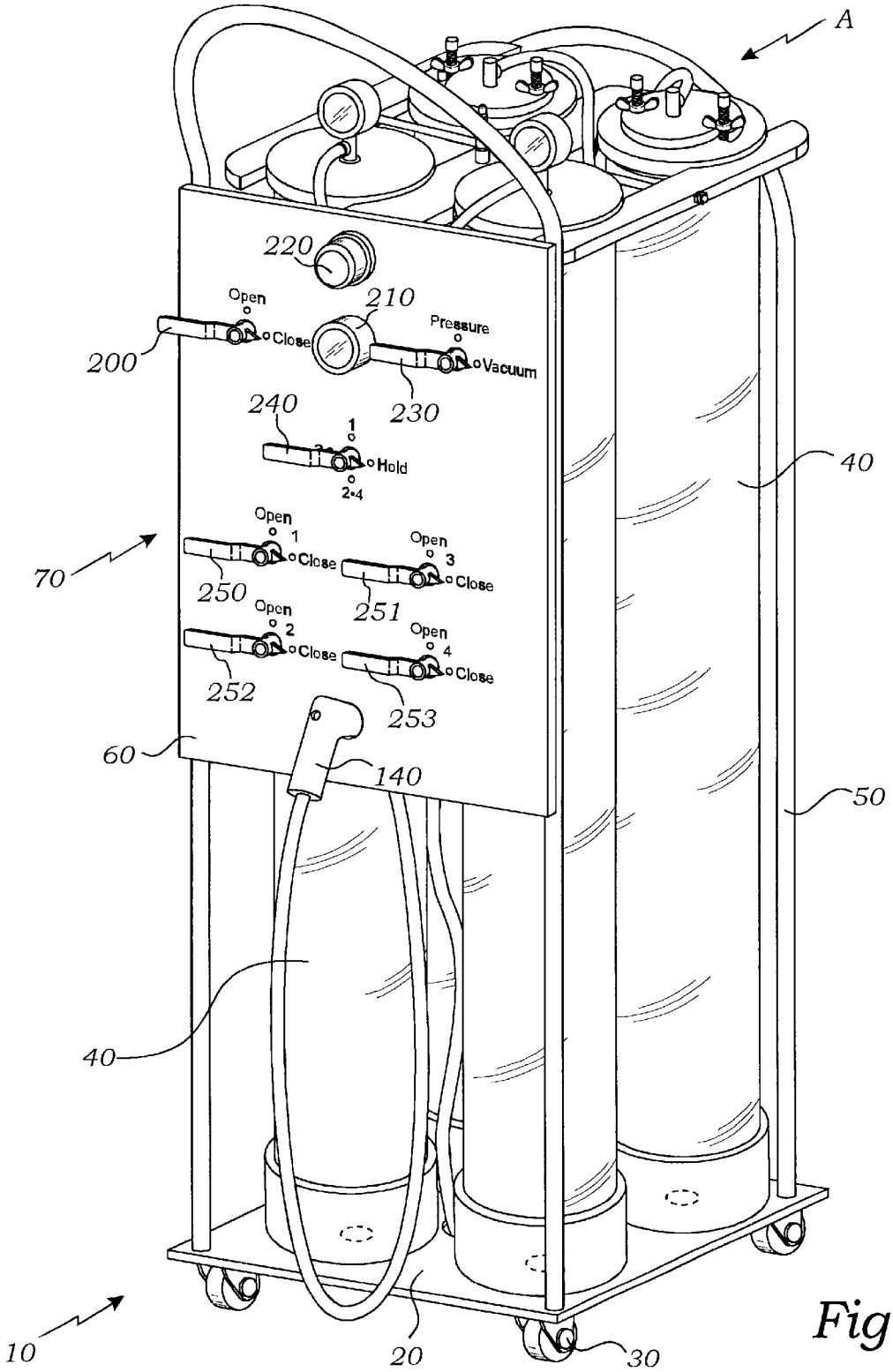
FIG. 1 is a perspective view of a first preferred embodiment of the invention.
Figure 2:
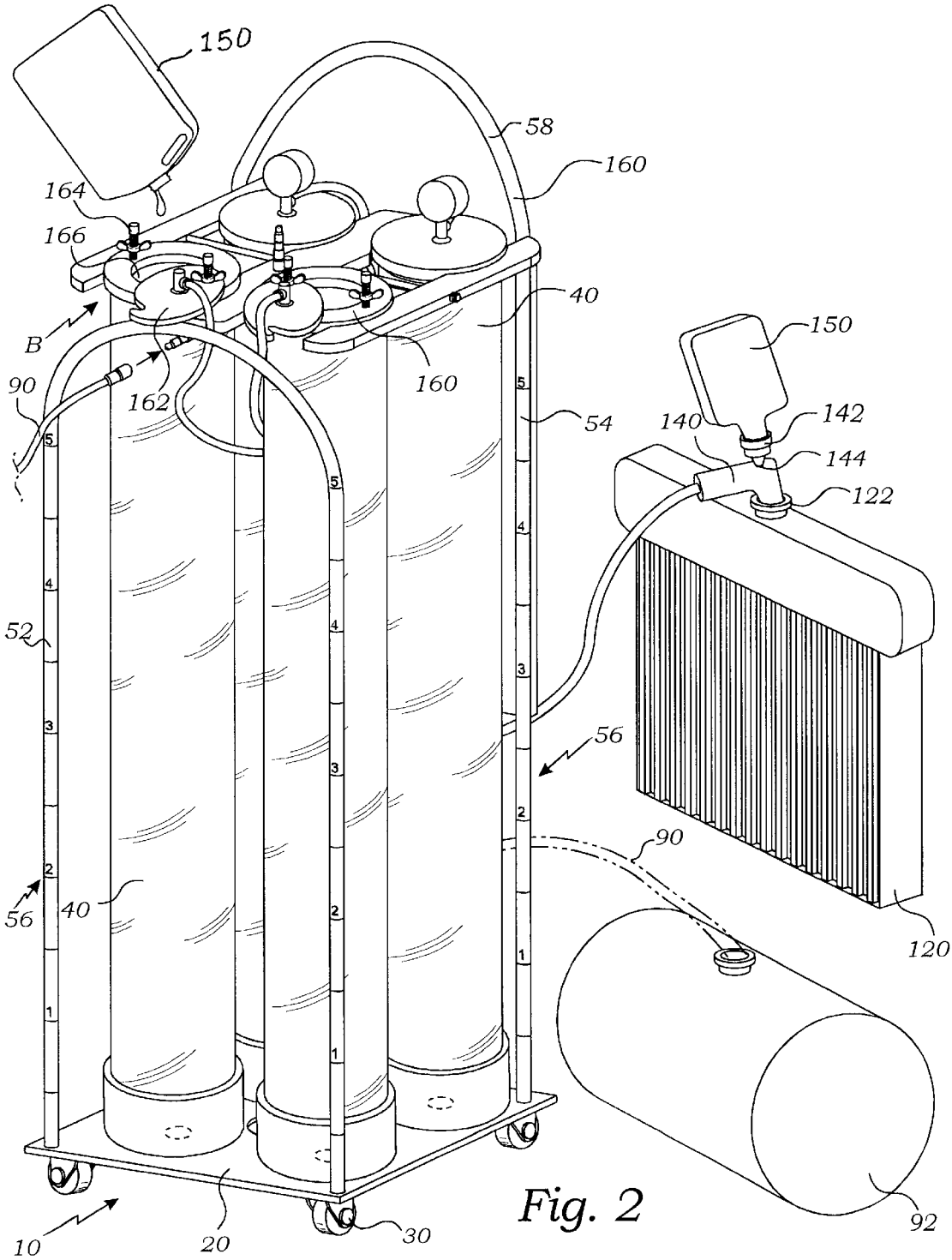
FIG. 2 is a similar view thereof showing its operation.

The present invention is an apparatus comprising a wheeled cart 10 made up of a platform 20 supported on a set of wheels 30 so that the cart 10 may be manually pushed from place to place. The platform 20 comprises a rigid plate having a flat upwardly facing surface. Mounted on the platform 20 is a plurality of containers 40 placed in adjacent upright attitudes as shown in FIGS. 1, 2, 6, 8 and 10. The containers 40 are preferably constructed as cylinders with capped ends and made of glass, polycarbonate, or any other structural transparent substance so that one may view the contents of a contained fluid, as to color, level, quality and any other attributes. A support framework 50 is engaged with the platform 20 and supports an operator's panel 60 which provides operator's controls 70 as well shown in FIGS. 1, 6, 8, and 10. Preferably, the support framework 50 comprises a pair of U-shaped rods 52 and 54, with the rod 54 extended for providing a handle 58. The support framework 50 provides level indicating indicia 56 as shown in FIG. 2. This is clearly shown in FIGS. 1, 2, 6, 8 and 10. The controls 70 are associated with a suction developing means 80 such as an ejector which is preferably a common, well known, device which uses the flow of a compressed gas to generate a minor negative suction through the Bernoulli effect, a pressure developing means, which may be any source of gas pressure such as a compressor (not shown) and used in conjunction with a compressed gas storage tank 92 (FIG. 2) and delivery hose 90 (FIG. 3), conduit switching means 200 such as manual or automatic valves, and conduit manifolding means 110 such as the manifolds shown in FIGS. 3, 7, 9 and 11.

Figure 3:
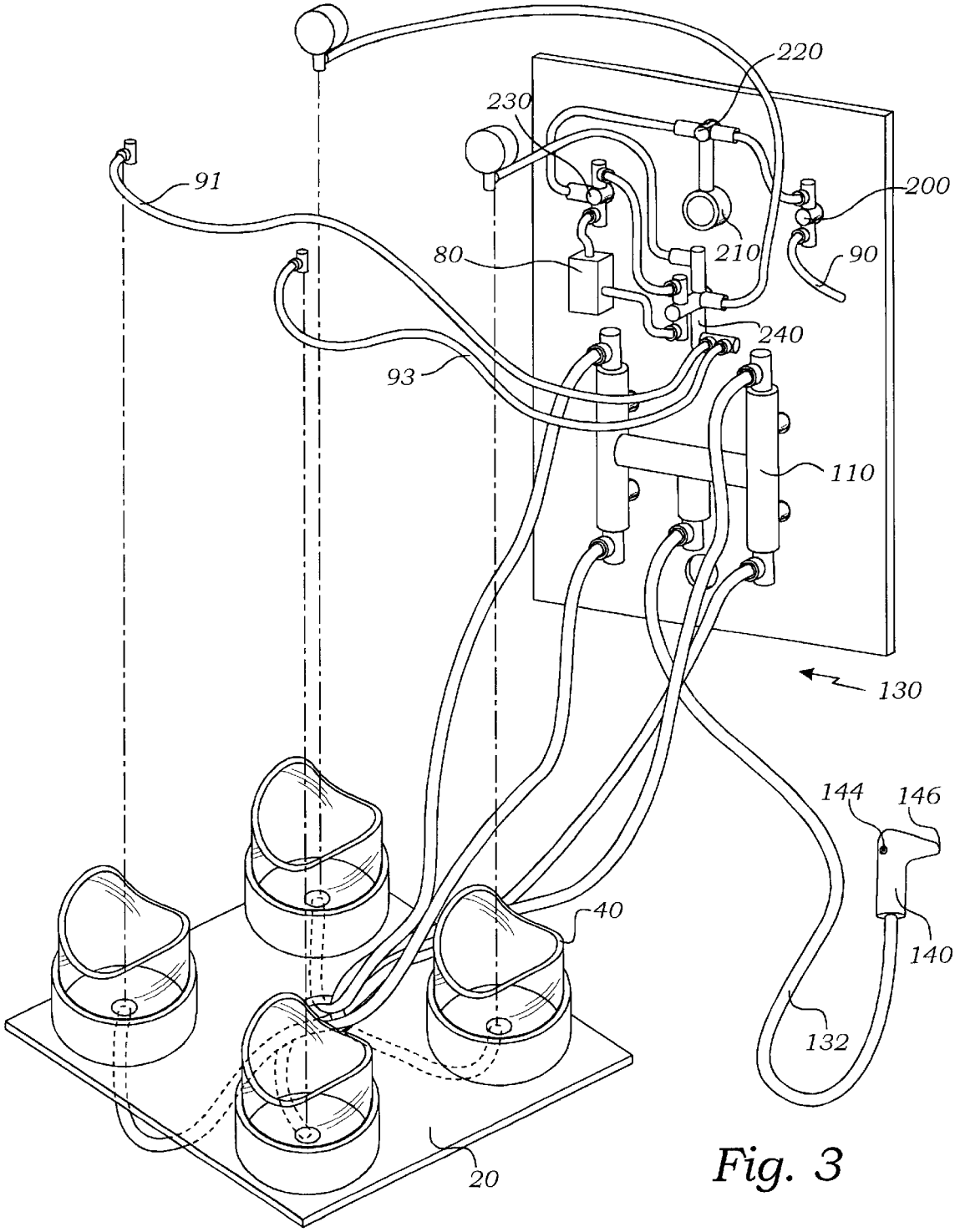
FIG. 3 is a similar view thereof showing the back of a control panel with cable interconnections of the invention.
Figure 4:
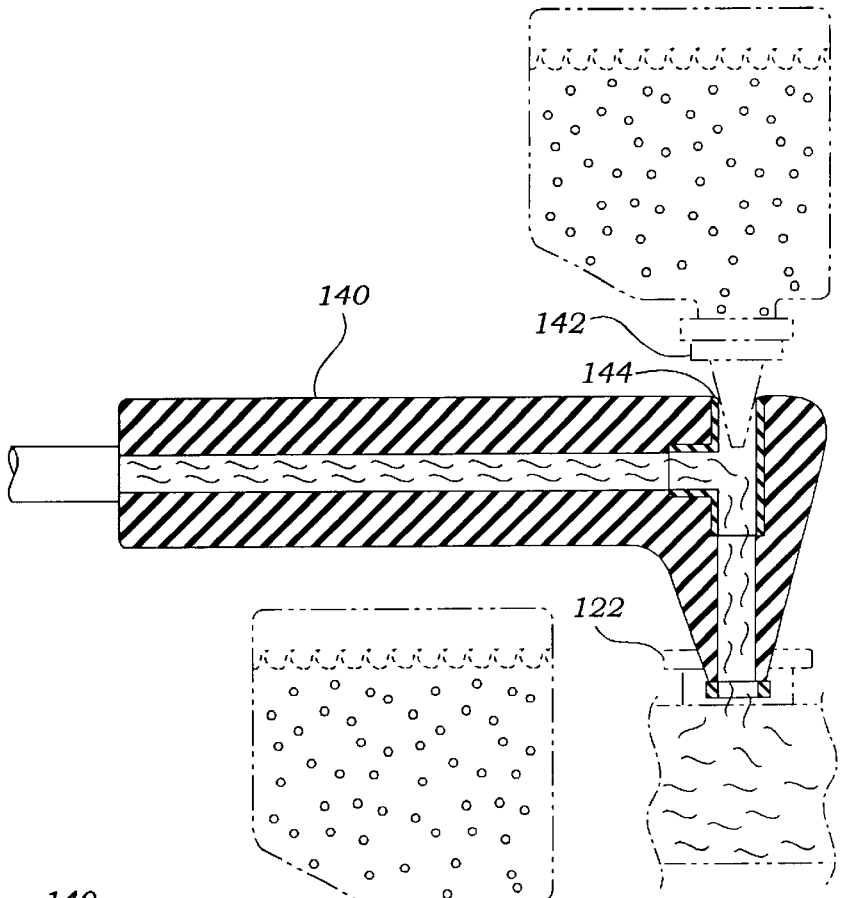
FIGS. 4 and 5 are side elevational sectional views thereof showing operation of a nozzle of the invention.
Figure 5:
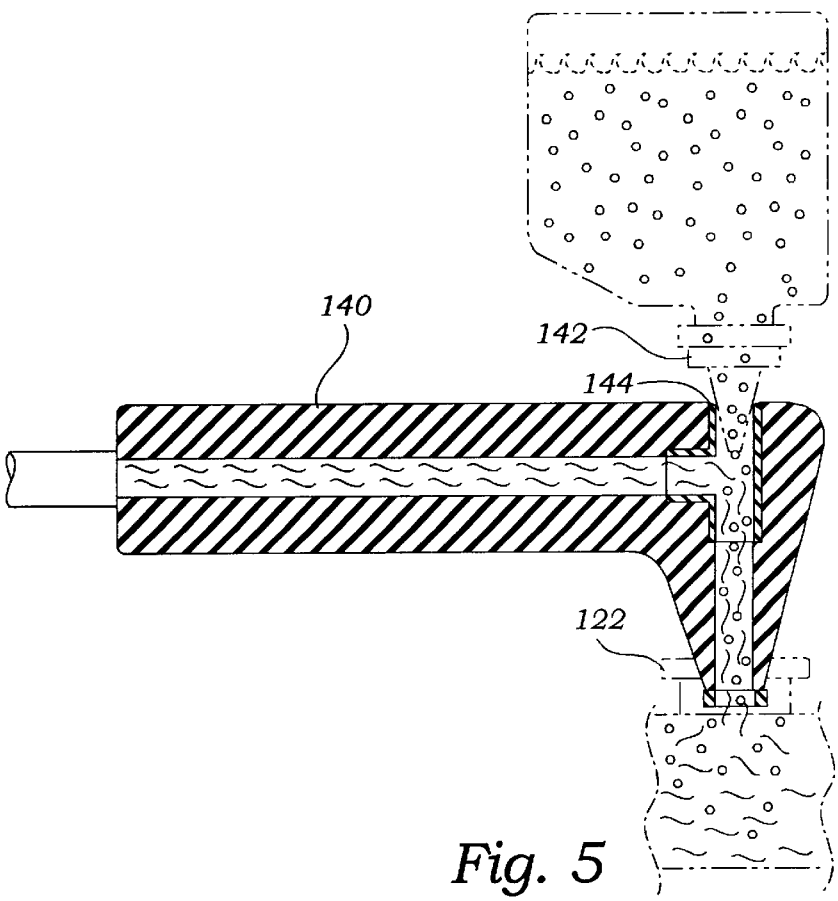

The controls 70 are enabled for acting together to apply vacuum and pressure exertion on fluids for driving the fluids between any one of the containers 40 and an automotive radiator 120 through a system of conduits 130. The arrangement of these controls 70 and conduits may be made in accordance with any design for application of fluids and is able to provide movement of the fluids driven by gas pressure or by suction. For instance, a suction may be applied to the radiator 120 shown in FIG. 2, to draw down a negative pressure within this radiator 120. By stoppering the radiator it then is possible to maintain the negative pressure and to use it to draw liquids from the containers 40 into the radiator 120. Any number of fluids may thus be drawn and in any order. In the same manner it is possible to draw liquid fluids from the radiator 120 into any one of the containers. Selection is made via the control panel 70. In the preferred embodiment, as shown in FIGS. 1 and 3, air pressure is applied through conduit 90 to control 200, an open-close valve. Pressure gauge 210 reads the pressure level as supplied. Regulator 220 adjusts the pressure as desired. Pressure-vacuum valve 230 selects the mode desired and whether pressure or vacuum, it is directed through valve 240 to desired containers 40. When the operating effect or mode selected is pressure, it is directed to the top of the appropriate container 40, as shown, for example by conduits 91 and 93 in FIG. 3 and fluids are forced then from the bottom of the appropriate selected container 40 into manifold 110 and selected by valves 250, 251, 252, and 253 to conduit 132 for delivery to the radiator 120. When mode is vacuum, it is applied for drawing fluid from the radiator 120 into one of the containers 40 and after all of the fluid is drawn therefrom, a partial vacuum condition remains in the radiator 120. Therefore, in this mode, liquid is drawn from the radiator 120, through nozzle 140 and delivery tube 132 to manifold 110 and thus into a selected container 40. Suction is applied from selection valve 240 through, for instance, conduits 91 or 93. Preferably, one of the conduits 132 of the system of conduits 130 terminates with a nozzle 140 adapted by its shape and elastic material properties for sealing a radiator fill pipe nipple 122 while exchanging the fluids therewith. This is clearly shown in FIG. 2. The ability to seal the pipe nipple 122 is important so that suction may be held within the radiator 120 during fluid transfer as discussed above. The nozzle 140 may receive a valve 142 for admitting a fluid into the nozzle 140 through a nozzle aperture 144 situated above the nozzle's discharge point 146. A fluid containing bottle 150 delivers chemicals such as cleaning and conditioning agents or other fluids to radiator 120. The nozzle aperture 144 is adapted by its shape for engaging the valve 142 which is necessary to prevent loss of suction when the fluid bottle 150 is placed in an inverted position for draining the fluid bottle 150 through the valve 142 into the nozzle 140 and thus to the radiator fill pipe nipple 122 and the radiator itself 120. This is best seen in FIG. 2. It should be recognized that the present system works by reverse suction technique. The radiator is reduced to a low pressure by direction suction. Thereafter, the radiator provides suction for drawing fluids from the containers 40 or a bottle 150, inverted and inserted into the nozzle. Therefore, valve 142 plays the important role of sealing the system while the bottle 150 is placed into the nozzle.

The containers 40 are preferably closed by a threaded connection with a disk-shaped metal cap 160. The cap 160 provides a fastened cover 162 engaged with the cap 160 by threaded studs 164. The cover 162 is enabled, by this mounting for sliding movement between a closed position "A" for sealing the cap 160, and an open position "B" for exposing a cap aperture 166 for receiving fluids into the container 40 as shown in FIG. 2. As shown in FIG. 2, an alternate cap 160' may be applied, and this cap may use a pressure gauge or other instrument mounted on it for control and monitoring.

Clearly, the apparatus may include any number of the containers 40 depending upon the use the apparatus is to be applied to. In a 4 container configuration shown in FIGS. 1–3 and 10 the apparatus has the ability to receive spent coolant in one container 40 so as to empty the radiator 150, discharge fresh water from a second container 40 along with a cleaning fluid from a bottle into the radiator 150 to flush the radiator, receive the spent flush in yet another of the containers 40 and, finally, discharge new coolant from a fourth of the containers 40 into the radiator 150. Many other possibilities exist for the use of the containers in automotive maintenance. For instance, plural containers may be applied for large capacity cooling systems as one might find in diesel engines and such.

Figure 6:
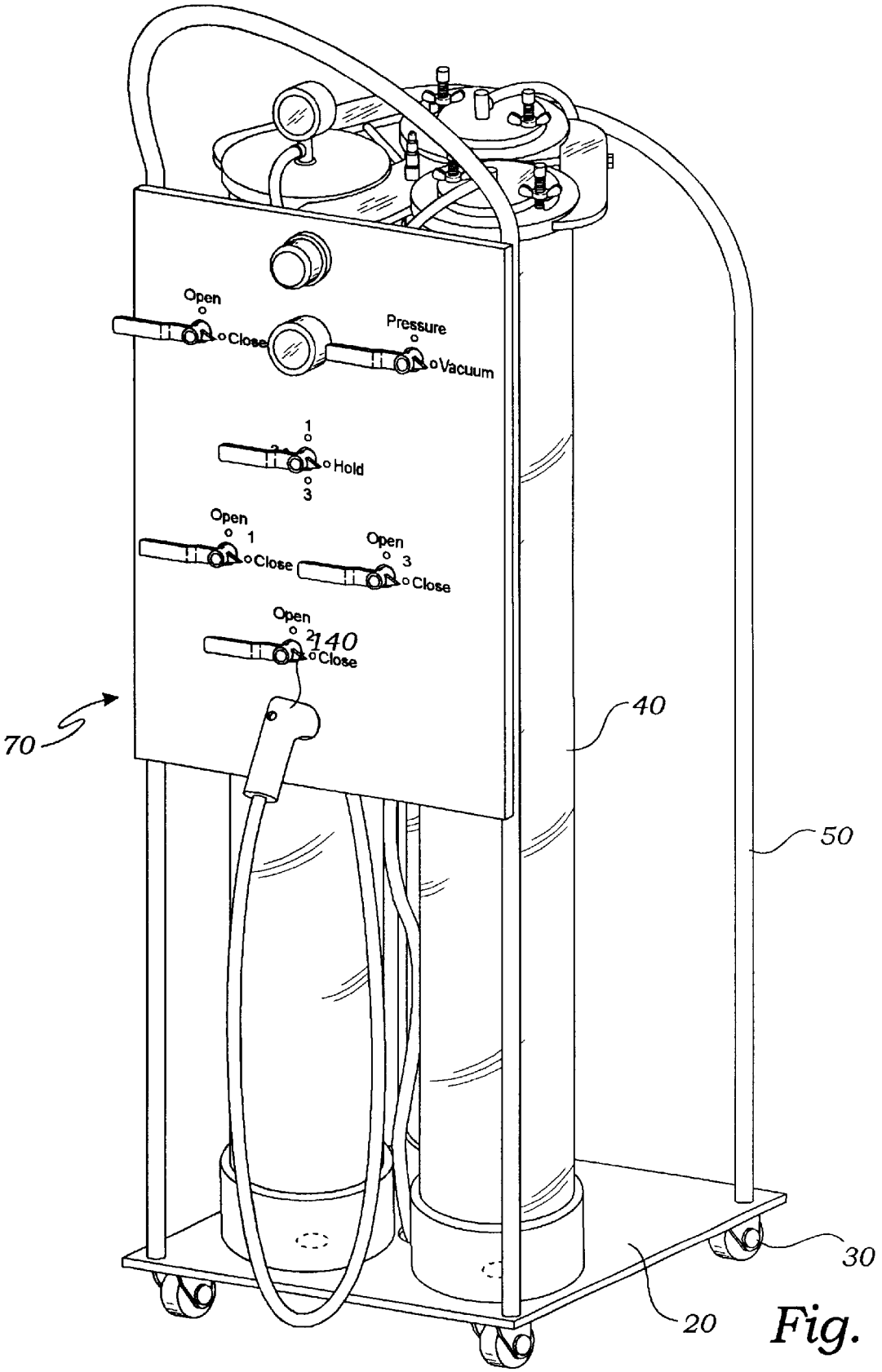
FIG. 6 is a perspective view of a second preferred embodiment of the invention.
Figure 7:
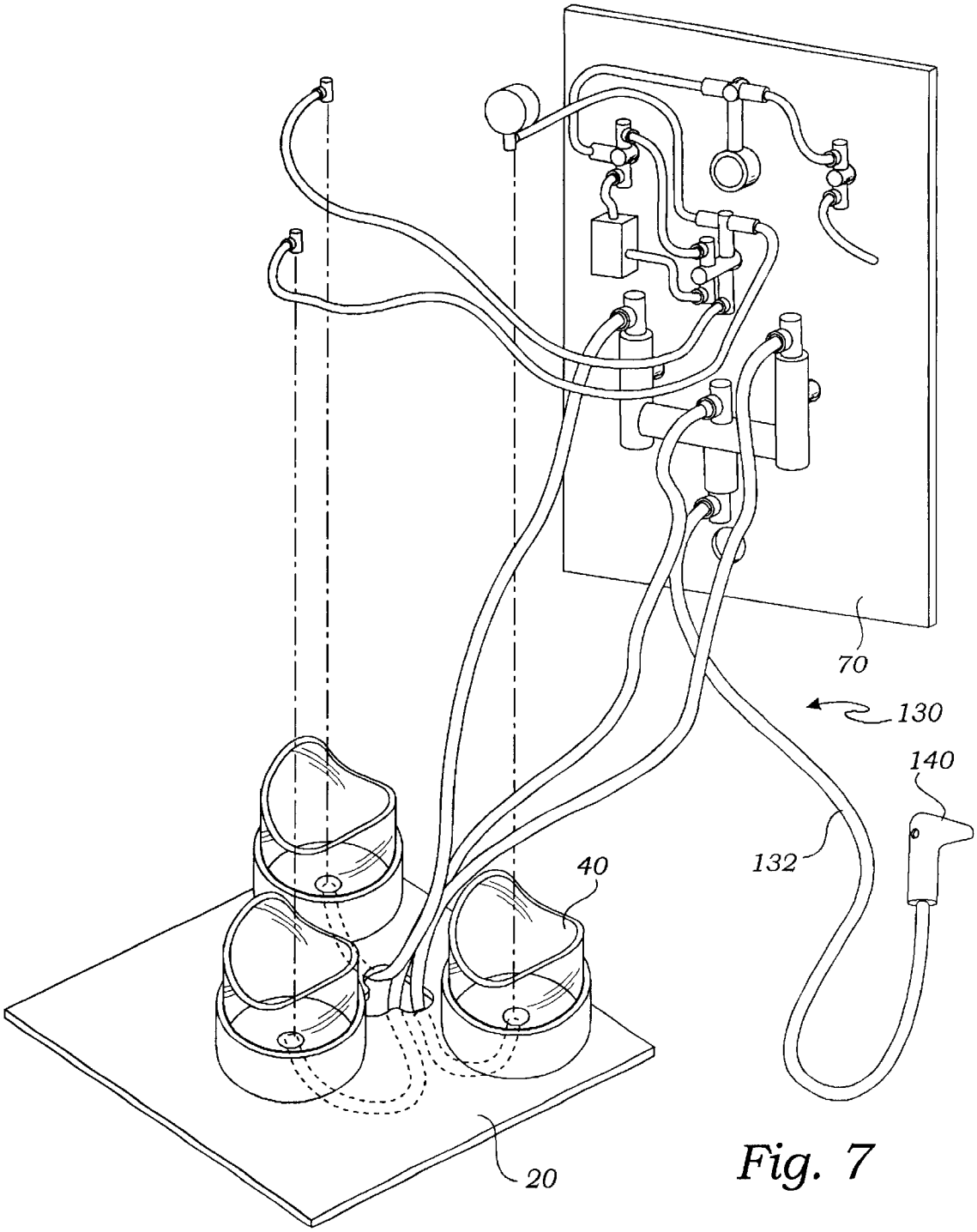
FIG. 7 shows the cable interconnections thereof.

In the configuration shown in FIGS. 6 and 7, the apparatus uses 3 containers 40 and is able thereby to receive spent coolant in one container 40, flush with fresh water from a second container 40 and cleaner from a bottle, and install new coolant from a third of the containers 40. In this case the flush is allowed to drain by gravity into an accessory container.

Figure 8:
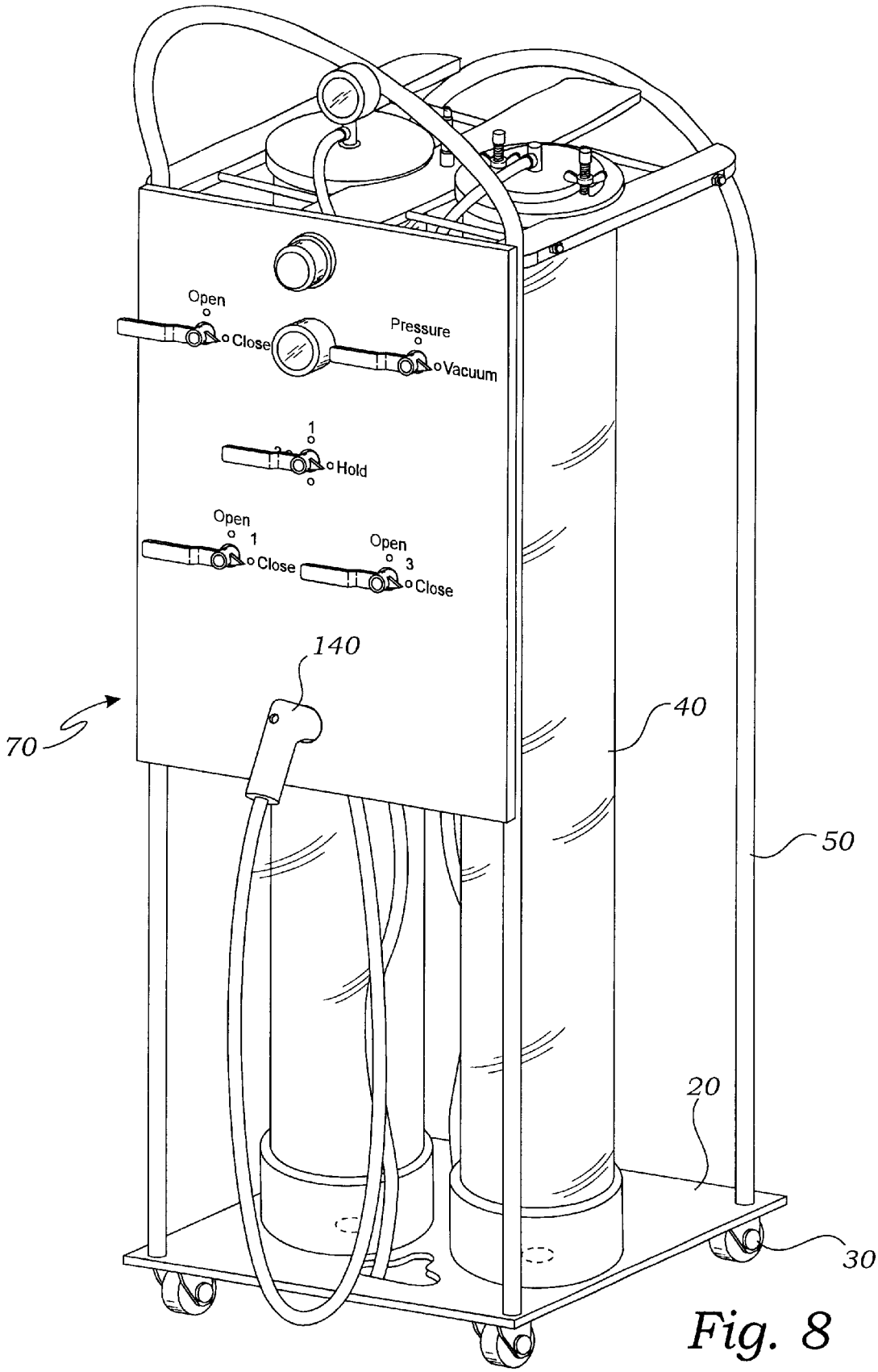
FIG. 8 is a perspective view of a third preferred embodiment of the invention.
Figure 9:
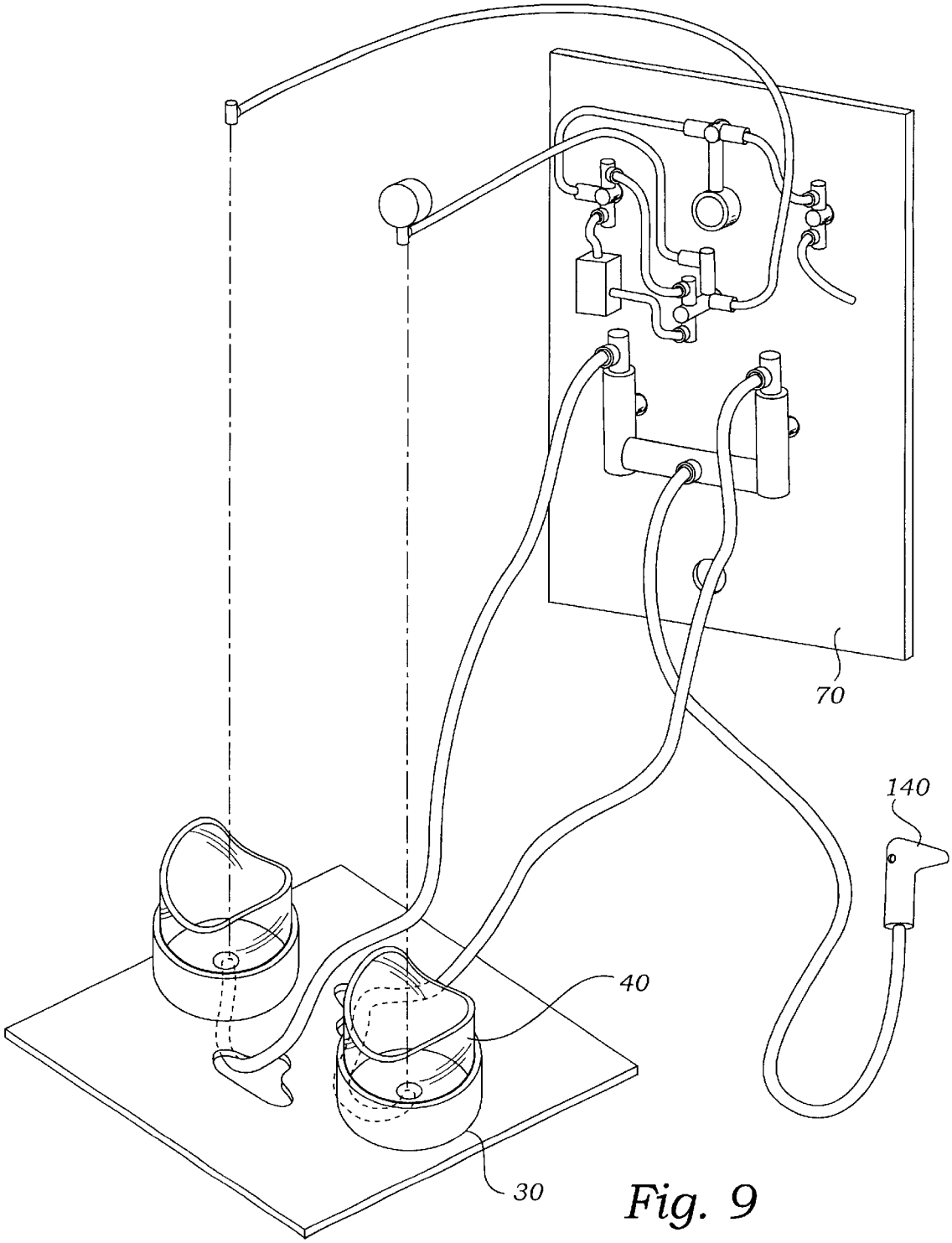
FIG. 9 shows the cable interconnections thereof.
Figure 10:
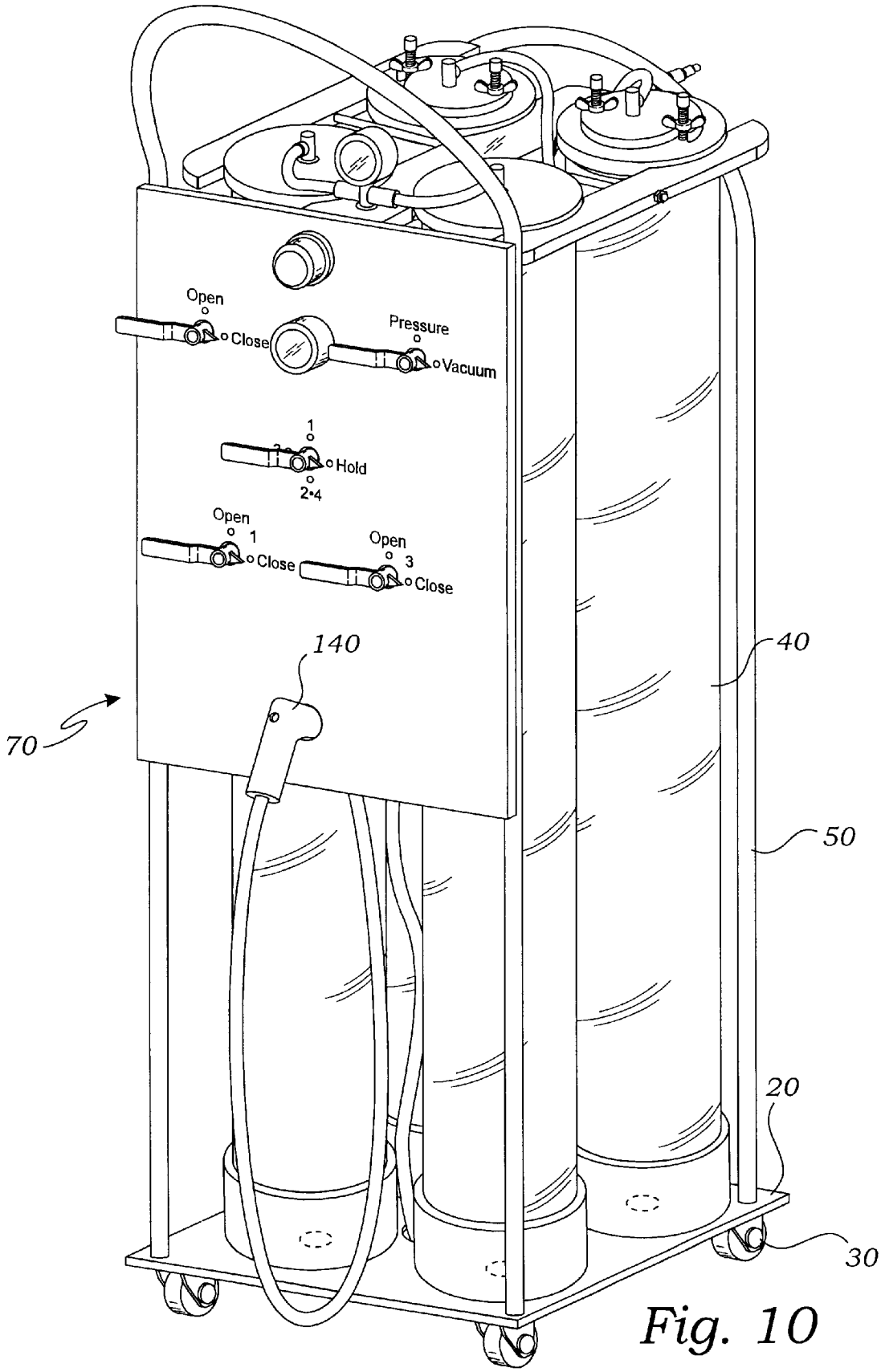
FIG. 10 shows a modification of the first embodiment shown in FIG. 1.
Figure 11:
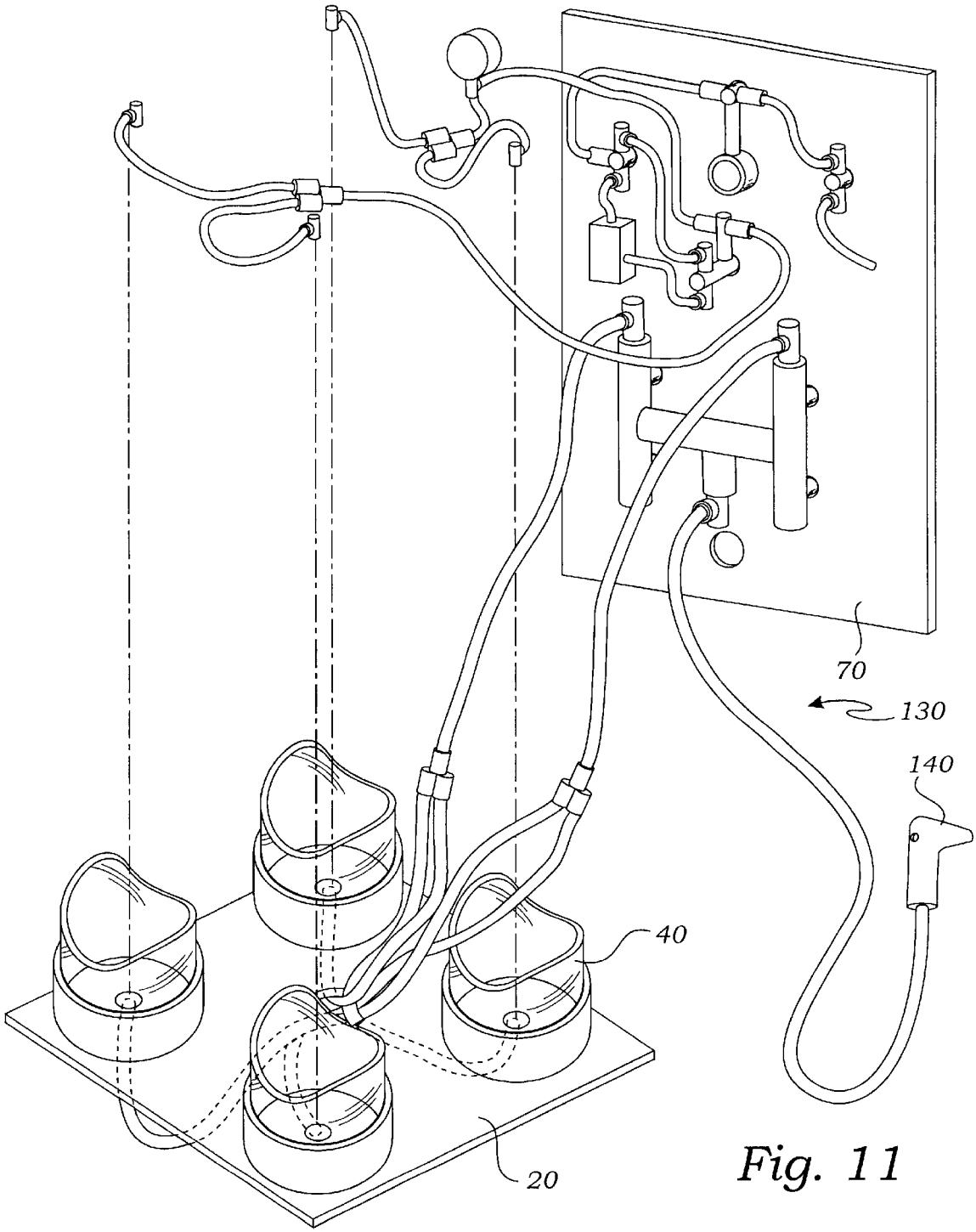
FIG. 11 shows the cable interconnections thereof.

In the configuration shown in FIGS. 8 and 9, the apparatus uses 2 containers 40 and is able thereby to receive spent coolant in one container 40, and install new coolant in a second of the containers 40. This shortcut approach may be most applicable for new automobiles where the coolant system is not very dirty.

Obviously, the number of applications, fluids, containers and the method steps for providing radiator and other types of automotive and non-automotive maintenance is not limited to the few example shown here, but is open to a vast number of potential situations and possibilities.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising: a wheeled cart, and mounted on the wheeled cart a plurality of containers placed in adjacent upright attitudes; a support framework engaged with the wheeled cart; the support framework holding an operator's panel with operator's controls mounted thereon including; suction developing means, pressure developing means, conduit switching means, and conduit manifolding means, enabled for acting together to apply vacuum and pressure exertion on fluids for driving such fluids between at least one of the containers and an automotive radiator through a system of conduits.

2. The apparatus of claim 1 wherein one of the conduits of the system of conduits terminates with a nozzle adapted for sealing a radiator fill pipe nipple while exchanging said fluids therewith, the nozzle engaging a valve for admitting a fluid thereinto through a nozzle a tight fitting aperture in the nozzle.

3. The apparatus of claim 2 further comprising a fluid bottle, the valve adapted for tight fitting engagement with the nozzle aperture whereby the fluid bottle is held in an inverted position for draining the fluid bottle through the valving means into the nozzle for entry into the radiator fill pipe nipple.

4. The apparatus of claim 1 wherein at least one of the containers is closed by a threaded connection with a disk-shaped cap, the cap providing a fastened cover partially engaged by a threaded stud, the cap enabled for sliding movement between a closed position for sealing the cover, and an open position exposing an aperture in the cover for receiving fluids into the at least on of the containers.

5. The apparatus of claim 4 wherein the plurality of containers is 4 such containers interconnected for respectively receiving spent coolant, water, spent flush and new coolant.

6. The apparatus of claim 4 wherein the plurality of containers is 3 such containers interconnected for respectively receiving spent coolant, water and spent flush.

7. The apparatus of claim 4 wherein the plurality of containers is 2 such containers interconnected for respectively receiving spent coolant and spent flush.

8. The apparatus of claim 1 wherein the support framework comprises a pair of inverted U-shaped rods wherein one of the rods provides a handle portion adapted for pushing the apparatus on the set of wheels.

9. The apparatus of claim 8 wherein the U-shaped rods provide an indicia adapted for indicating quantitative fluid level in the containers.

10. The apparatus of claim 1 wherein the fluids are expelled from and drawn into the containers through a caps positioned on bottom terminal ends of the containers.

11. The apparatus of claim 2 wherein the operators panel provides a nozzle aperture for receiving the nozzle when not in use.

12. The apparatus of claim 1 wherein the support framework includes a pair of spaced apart, horizontally disposed yolks with contour fitted surfaces engaging the containers for engagement and support thereof.

* * * * *